United States Patent [19]

Storandt

[11] 4,225,150

[45] Sep. 30, 1980

[54] SKI BINDING INCORPORATING A SKI BRAKE

[75] Inventor: Ralf Storandt, Leonberg, Fed. Rep. of Germany

[73] Assignee: Vereinigte Baubeschlagfabriken Gretsch & Co. GmbH, Leonberg, Fed. Rep. of Germany

[21] Appl. No.: 880,458

[22] Filed: Feb. 23, 1978

[30] Foreign Application Priority Data

Feb. 23, 1977 [DE] Fed. Rep. of Germany ..... 2707769

[51] Int. Cl.[3] ..... A63C 5/00

[52] U.S. Cl. ..... 280/605

[58] Field of Search ..... 280/604, 605; 188/5

[56] References Cited

U.S. PATENT DOCUMENTS

| | | | |
|---|---|---|---|
| 3,877,709 | 4/1975 | Fritz | 280/605 |
| 3,899,184 | 8/1975 | Haddad | 280/605 |

FOREIGN PATENT DOCUMENTS

| | | | |
|---|---|---|---|
| 2408941 | 9/1975 | Fed. Rep. of Germany | 280/605 |
| 2410297 | 9/1975 | Fed. Rep. of Germany | 280/605 |
| 2228504 | 5/1973 | France | 280/605 |

*Primary Examiner*—Robert B. Reeves
*Assistant Examiner*—Gene A. Church

[57] ABSTRACT

A ski binding exemplified by a heel binding has an in-built brake of the kind which utilizes pivoted brake arms to dig into the snow to stop a lost ski. A resetting lever is provided to pivotally return the brake arms to their inoperative position. The resetting lever is generally in the form of a hoop passing around the back of the binding housing and connected to a shaft passing through the binding housing. Mechanisms including stops are disclosed which allow a skier to reset the brake arms by either pushing or pulling on the lever.

22 Claims, 14 Drawing Figures

SKI BINDING INCORPORATING A SKI BRAKE

The invention relates to a ski binding provided with a ski brake in which a shaft extends transversely through the binding housing and is provided at at least one of its ends with a brake arm extending along the side of the ski and in which the brake is spring biased towards its deployed position.

Such ski brakes are used so that, following release of a ski boot from the binding, the brake arm swivels from an inoperative position, in which it lies generally parallel to the ski, to an operative position in which it is inclined e.g. at right angles, to the ski in order to check the movement of the 'lost' ski.

A problem with such ski brakes is how to return the brake arm from the braking position to the inoperative position.

For a ski brake which is separate from the binding this can be simply done as the ski boot is introduced into the binding. This is however not straightforwardly achieved when the ski brake is incorporated into the binding.

The object of the invention is to provide a ski binding incorporating a ski brake in which the ski brake can be moved from the operative to the inoperative position by a simply constructed and easily movable device.

This object should be achieved using low forces and the resetting device should itself take up a minimal amount of additional space.

To achieve this object the invention provides that a resetting lever preferably in the form of a hoop passes around the binding, and is freely pivotably movable relative to and about substantially the same axis as the shaft for the brake between two abutments.

The abutments are preferably angularly spaced apart by an amount corresponding to the range of pivotal movement of the arms. This construction enables simple hand movement applied to the resetting hoop, which is positioned above the ski, to be used to reset the braking arm from its operative to its inoperative position. Finally the resetting hoop can be allowed to pivot back to its original position so that it is in the same place for both the operative and inoperative positions of the brake arm.

Moreover, pivoting the resetting hoop upwardly is considerably easier than trying to manipulate the brake arm itself.

A preferred embodiment is so constructed that the ends of the resetting hoop are enlarged and provided with a cut out in the form of a sector of a circle so that the radial walls bounding the missing sector act as abutments on which the brake arms engage.

The resetting hoop and the brake arms can thus pivot freely with respect to each other through the angular range determined by the angle of the sector.

The shaft interconnecting the two brake arms preferably passes through a coaxial bore provided in the enlarged portions at the ends of the resetting hoop.

In this manner the resetting hoop is secured without trouble to the binding so that the freedom of rotation of the resetting hoop and the brake arms is not disadvantageously affected.

The connection of the resetting hoop to the binding is also made very simple.

Preferably the resetting hoop is provided in combination with a ski binding in which a shaft passes transversely through the binding housing and is connected to brake arms on each side of the binding housing.

The resetting hoop has preferably two side shanks and a cross leg which joins together the two ends of the side shanks. The cross leg is preferably positioned behind the binding housing and is bent upwardly at its ends so that it can be more readily grasped. The resetting hoop can then be pivoted upwardly into the space above the binding.

It is especially advantageous for the side shanks of the resetting hoop to be placed to the inside of the brake arms so that the resetting hoop and the brake arms can pivot past each other, and it is also then possible for both of them to lie alongside each other in the inoperative position. The resetting hoop is then covered from sight by the brake arms which gives a good visual compression and furthermore damage to the resetting hoop is prevented during normal skiing because it is protected behind the braking arm which is of robust construction.

Embodiments of the invention will now be described by way of example only and relative to the accompanying drawings in which.

Figure 6:
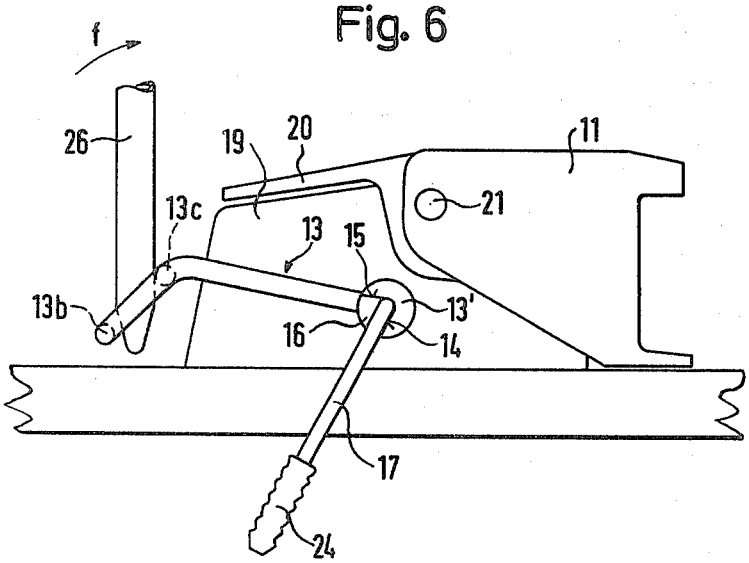

FIG. 6 a schematic side view of a further embodiment of a ski binding incorporating a ski brake.

Figure 7:
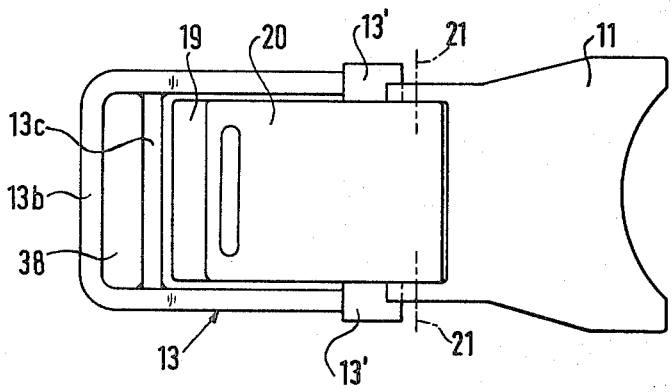

FIG. 7 a plan view of the subject of FIG. 6.

Figure 8:
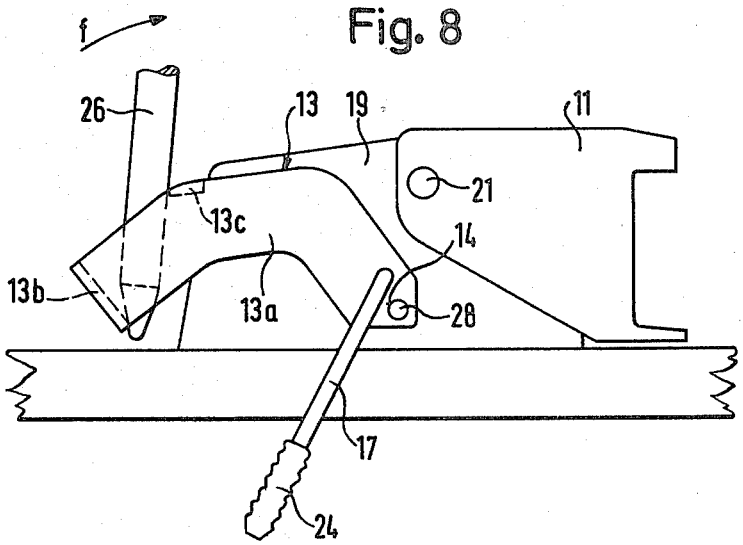

FIG. 8 a schematic side view of a further advantageous embodiment.

Figure 9:
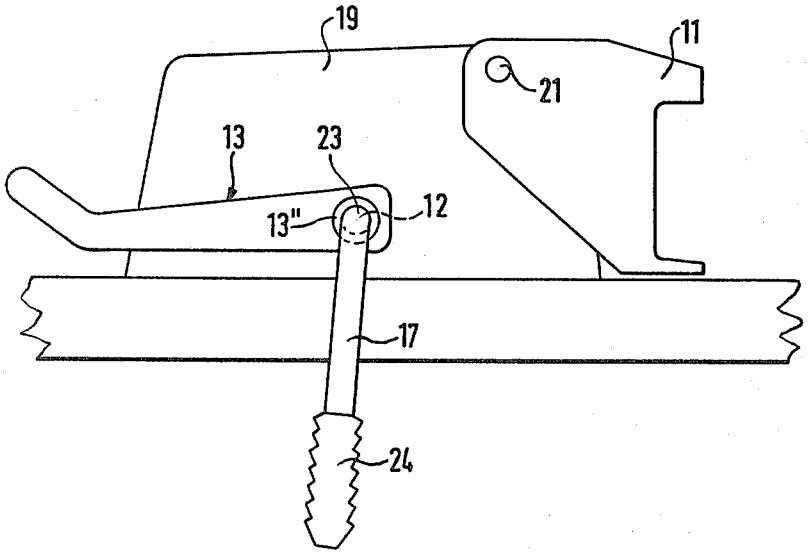

FIG. 9 a schematic side view of a further modification of the ski binding.

Figure 10:
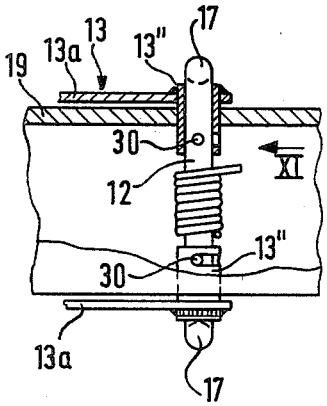

FIG. 10 is a sectioned part view of the subject of FIG. 9 as seen from above.

Figure 11:
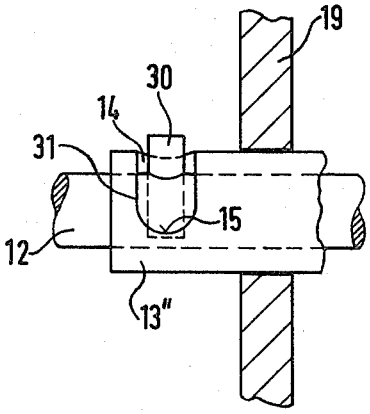

FIG. 11 is a view in the direction of the arrow XI of FIG. 10.

Figure 12:
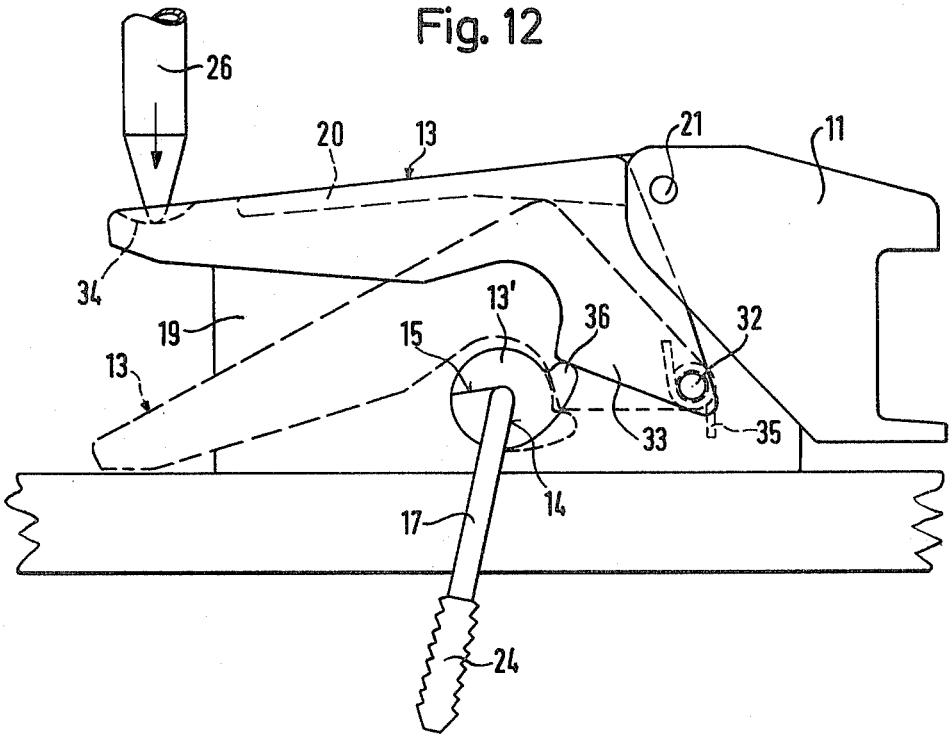

FIG. 12 is a schematic side view of a further embodiment.

Figure 13:
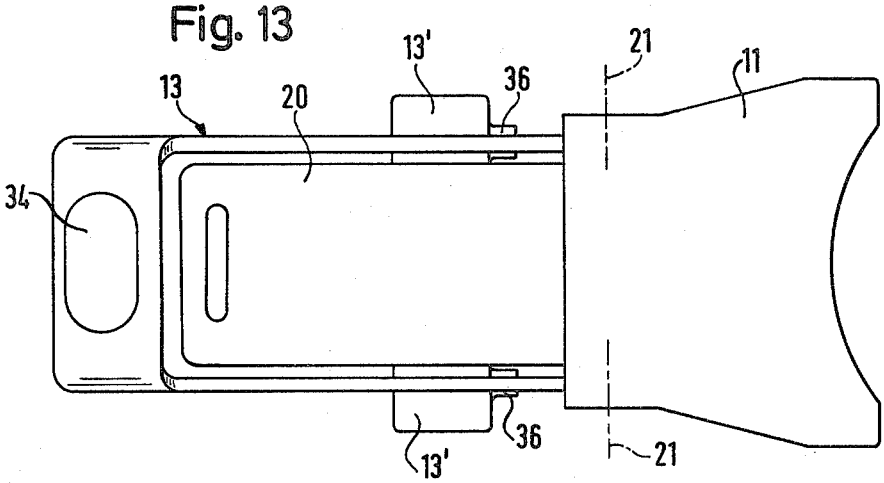

FIG. 13 is a plan view of the subject of FIG. 12 and

Figure 14:
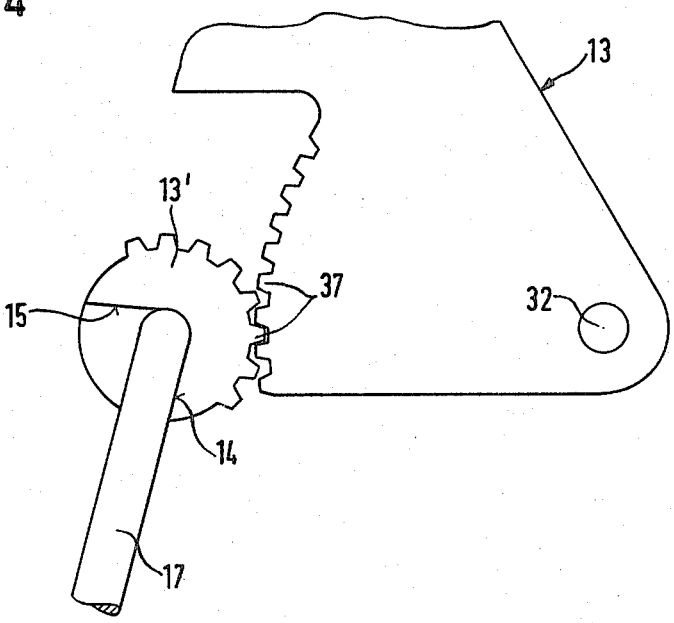

FIG. 14 is a section of a side view of an embodiment somewhat modified from that of FIGS. 12 and 13.

Figure 1:
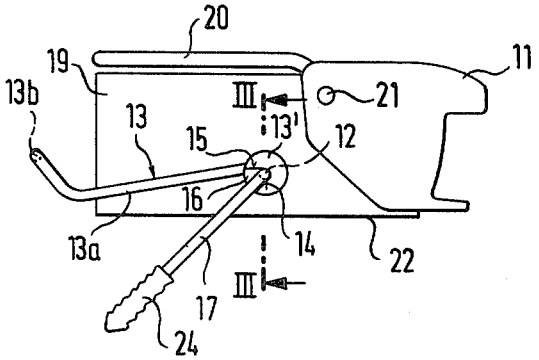
FIG. 1 is a schematic side view of a ski binding incorporating a ski brake.
Figure 2:
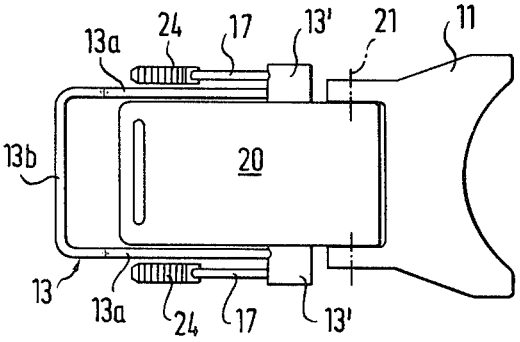
FIG. 2 is a plan view of the subject of FIG. 1.
Figure 4:
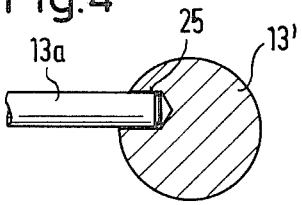
FIG. 4 is a section on the line IV—IV of FIG. 3.

According to FIGS. 1 and 2 the ski binding comprises a housing 19 to which a sole clamp 11 for the ski boot is pivotally connected about a pivot axis 21. The binding shown is a heel binding although the inventive concept can also basically be incorporated in a front binding.

The sole clamp 11 is held in its operative position as illustrated in FIGS. 1 and 2 by one or other of the known release mechanisms (not shown). On the occurence of excessive forces being applied vertically upwardly on the sole clamp the clamp can snap open and release the ski boot. A hand lever 20 makes it possible to open the binding by hand by means of an upward pull applied to the lever.

The base of the binding housing 19 is either directly fastened to the ski or to a plate which can be displaced rearwardly against the force of a spring in well known manner. This latter method of connection provides the preload in the forward direction which is nowadays customary with ski safety bindings.

A shaft 12 for a ski brake extends transversely through the binding housing i.e. horizontally at right angles to the longitudinal direction of the ski. The shaft 12 is rotatably supported in the side walls of the housing 19 and spring biased towards the deployed position by a spring (not shown).

In FIG. 1 the spring biasing is arranged to urge the shaft 12 to turn in the counter clockwise direction.

Figure 3:
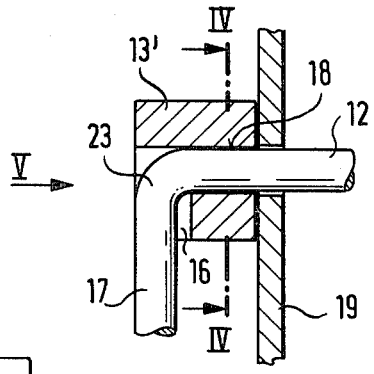
FIG. 3 is an enlarged view on the line III—III of FIG. 1.

Brake arms 17 are connected by bends 23 (FIG. 3) to the ends of the shaft 12 which project beyond the housing and, as can be seen in FIG. 1, extend in the deployed position sideways past the ski. In this position braking devices 24 applied to the ends of the arms dig into snow or ice, following release of the boot from the ski, and stop the ski in the desired manner.

In accordance with the present teaching a resetting hoop is provided to return the brake to its inoperative position and is basically a wire hoop 13 which extends in the shape of a 'U' around the rear part of the binding housing and has two side shanks 13*a* and a cross leg 13*b*. The side shanks 13*a* are bent, as can be seen in FIG. 1, in the upward direction so as to enable the cross leg to be gripped easily by hand.

At their forward ends the side shanks 13*a* finish at an enlarged generally cylindrical part 13' which is transversely orientated and the ends of the side shanks are fixed into radial bores 25 provided in these cylindrical parts.

Figure 5:
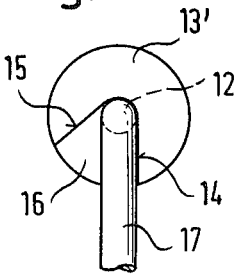
FIG. 5 is a view of the subject of FIG. 3 as seen in the direction of the arrow V.

The enlarged part 13' is modified by a provision of a cut out in the shape of a sector of a circle at one end face and the radial side walls 14, 15 of the remaining sector form abutment surfaces. This can be seen from FIGS. 3 and 5.

The enlarged cylindrical part 13' has a coaxial bore which is aligned with the bores in the wall of the binding housing to receive the ends of the shaft 12 for the ski brake. The brake arms 17 of the ski brake pass through the cut outs 16 and are connected to the cross shaft 12 in the vicinity of the bore 18.

The previously described construction makes it possible for the hoop 13 and the brake arms 17 to pivot freely relative to each other within the angular range permitted by the radial walls bounding the sector.

The arrangement is so contrived that in the deployed position of the brake arms 17 (FIG. 1) the hoop is positioned so that the abutment formed by the radial wall 14 is adjacent the brake arm 17.

If the hoop 13 is pivoted upwardly by hand, by grasping the cross leg 13*b*, the radial wall 14 causes the brake arm to also rotate upwardly. This pivotal movement can be continued until the brake arm reaches an approximately horizontal inoperative position.

In this position a latch device (not shown but well known per se) secures a lever connected to the cross shaft 12 so that the brake arm 17 is held in its inoperative position.

The hoop is now released whereupon it swings downwardly until it comes to rest on either the top surface of the ski or on the stop formed by the other radial wall of the cut out 15.

The side shanks 13*a* are desirably aligned with the radial direction of the stop 15 so that in the inoperative position the side shanks and the brake arms 17 lie approximately parallel to each other. The circular sector cut outs 16 and the bores 25 are sufficiently displaced sideways from each other to make it possible for the side shanks and the brake arms to overlap.

The latching and release mechanism for the ski brake is preferably constructed in the manner disclosed and described in U.S. Ser. No. 880,496 filed Feb. 23, 1978 and entitled "Improvements in Ski Safety Bindings incorporating Ski Brakes" and described in German Patent Publication OS No. 27 07 772 filed Feb 23, 1977 entitled "Ski Binding with a Sole Clamp and an Inbuilt Ski Brake" and German Patent Publication No. OS 27 07 771 filed Feb. 23, 1977 and entitled "Ski Safety Binding with a Sole Clamp Pivotally Arranged on a Base and an Inbuilt Ski Brake".

In all embodiments the same reference numerals will be applied to corresponding parts.

The embodiments of FIGS. 6 and 7 is generally similarly constructed to the ski binding and incorporated ski brake as described in relation to FIGS. 1 to 5. The resetting hoop 13 is however bent downwardly at its rear end and is provided with a further cross leg 13*c* in the vicinity of the bend. The further cross leg 13*c* is so arranged relative to the first cross leg 13*b* that a space exists between both legs into which the tip of a ski stick can be inserted; this is shown in FIG. 6.

Because of the vertical displacement of the cross leg 13*c* relative to the cross leg 13*b* tipping of the ski stick in the direction of the arrow f means a lifting movement can be exerted on the hoop. The skier does not therefore need to bend in order to operate the hoop 13.

The embodiment of FIG. 8 shows a hoop 13 which is not constructed out of stiff wire as were the hoops of the previous embodiments, instead the hoop is made out of sheet metal. As before two cross legs 13*b*, 13*c* make it possible to operate the hoop with the ski stick as explained in connection with FIGS. 6 and 7.

In place of the enlarged portion 13' of the previous example the hoop 13 has bolts 28 on either side of the rotational axis which extend sideways beneath the brake arms 17 and form the abutment stops 14. On upward pivoting of the hoop 13 the abutments engage the brake arms so that they can be pivoted from the operative position of FIG. 8 to the inoperative position.

From FIG. 8 it is clear that to bring about the teaching of the invention the essential abutment is that one which is operative to move the brake arms 17 to their inoperative position, i.e. the abutment 14. The abutment 15 of the previous embodiment has in contrast solely the function of limiting the downward movement of the hoop 13 when the brake arms are in their inoperative position.

In the present embodiment the hoop can also be of sheet metal instead of wire.

In the embodiment of FIG. 8 it is also possible for the bolts 28 to pass through elongate slots (not shown) in the housing 19 into the interior of the binding where it can engage any parts of the ski brake that are rotationally fixed to the brake arms 17.

The embodiments of FIGS. 9 to 11 illustrates a further way of transmitting the operating force from the hoop 13 to the shaft 12 whilst returning the ski brake to its inoperative position. Members 13'' with cylindrical bores are provided at the end of the side shanks 13*a* and are rotatably supported on the shaft 12. As can be seen from FIGS. 10 and 11 an elongate slot is provided around the periphery of each member through which protrudes pin 30 which is connected to the shaft 12. The end faces of the elongate slot form the abutments 14 and 15.

In FIG. 10 there can also be seen a spring 29 which biases the brake arms 17 towards the deployed position.

The operation of the embodiments of FIGS. 9 to 11 is similar to the manner of operation of the previous examples. By lifting the hoop 13' the abutment 14 comes into engagement with the stop pin 30 so that the shaft 12 is rotated in the sense of resetting the ski brake to its inoperative position. The second abutment is angularly spaced from the abutment 14 so that free pivotal movement of the hoop 13 is possible up to a size of angle that is greater or the same as the angle through which the brake pivots.

FIGS. 12 and 13 show an embodiment in which the brake arms 17 can be returned to their inoperative position by means of pressure applied downwardly on the hoop 13.

To achieve this the hoop is pivoted about a transverse axis 32 which lies in front of the shaft 12 and is urged by an auxiliary spring 35 to its uppermost position. A lever arm 33 is provided on the hoop and bears on a nose 36 provided on a member on the transverse shaft 12 of the ski brake. This member is of greater diameter than the arm of the ski brake and is profiled similarly to the manner described in relation to FIGS. 1 to 7.

At the rear end of the hoop 13 there is provided a depression 34 into which the ski stick tip 26 can be inserted from above.

On depressing the ski stick from above the hoop moves into the position shown in dotted lines in FIG. 12. This causes the nose 36 and the part 13' to be pressed by the lever arm 33 into the position correspondingly indicated in dotted lines and this moves the braking arms 17 from the operative to the inoperative position. The example of FIGS. 12 and 13 thus provide an inversion of the direction of resetting movement of the hoop so that the ski brake can be returned to the inoperative position by pressing instead of pulling.

FIG. 14 shows a further possibility for producing the inversion of the direction of resetting movement. The part 13' and a neighbouring region of the hoop are provided with meshing gear teeth 37 which causes the operating lever and the brake arms to counter-rotate. The meshing gear teeth thus have a function similar to that of the lever arm 33 and the mating nose 36 of FIGS. 12 and 13.

In all embodiments so far described all the resetting elements are arranged outside of the binding. In principle however, at least the follower part 13 could be arranged inside of the binding housing. In this case it would be possible for the operating lever to project rearwardly through a slit at the rear of the binding housing.

I claim:

1. A ski binding incorporating a ski brake and comprising a binding housing, at least one brake arm, a shaft passing transversely through the binding housing and pivotally supporting said at least one brake arm for pivotal movement between a deployed brake position in which it extends below the binding housing and an inoperative position substantially alongside the binding housing, a spring means for biasing said at least one brake arm towards said deployed position, a resetting lever pivotally connected to the housing for movement from a rest position to a brake resetting position, and a first cooperating pair of abutment means respectively associated with the resetting lever and the brake arm and shaft, said cooperating abutment means being disposed so as to contact one another to produce resetting movement of said at least one brake arm from said deployed position to said inoperative position on movement of said resetting lever from said rest position to said brake resetting position and to permit relative movement between the resetting lever and said at least one brake arm to permit unhindered return of said resetting lever to said rest position and unhindered deployment of said at least one brake arm from said inoperative position to said deployed position.

2. A ski binding according to claim 1, in which the pivot axes for said resetting lever and said shaft are coaxial.

3. A ski binding according to claim 2, in which a second pair of cooperating abutment means is also associated with said resetting lever and the brake arm and shaft, said second pair of cooperating abutment means being adapted to contact each other when said at least one brake arm is in said inoperative position to thereby determine the rest position of the resetting lever.

4. A ski binding according to claim 3, in which said resetting lever comprises a hoop passing around the binding housing, the ends of said hoop being provided with portions of relatively enlarged size, at least the portion of the end of said hoop associated with said at least one brake arm including a sector shaped recess cut from a circle centered on a transverse axis of said shaft, and wherein said first and second cooperating sets of abutment means respectively comprise respective ones of the two radial walls of the remaining sector bounding said recess and cooperating means provided on said at least one brake arm.

5. A ski binding according to claim 2, in which said resetting lever comprises a hoop passing around the binding housing, the ends of said hoop being provided with portions of relatively enlarged size, the portions having coaxial bores formed therein, and in which the shaft for the brake passes through both said coaxial bores.

6. A ski binding according to claim 1, in which two brake arms are provided disposed one to either side of the binding housing.

7. A ski binding according to claim 1, in which said resetting lever is a hoop passing around said binding housing and comprising two side shanks connected at their ends remote from the said axis by a cross leg.

8. A ski safety binding according to claim 7, in which said cross leg is positioned behind said binding housing.

9. A ski binding according to claim 8, in which the rear end of the hoop is bent upwardly relative to said side shanks.

10. A ski binding according to claim 7, in which said resetting lever comprises a hoop passing around said binding housing, the hoop having two side shanks interconnected by a cross leg, the two shanks being disposed inwardly of said brake arms.

11. A ski binding according to claim 3, in which two brake arms are provided, one disposed to either side of said binding housing, and wherein said resetting lever comprises a hoop passing around the binding housing, the hoop having two side shanks interconnected by a cross leg, the two shanks being disposed inwardly of the brake arms.

12. A ski binding according to claim 8, in which said hoop is provided with an additional cross leg interconnecting the two shanks, said additional cross leg being spaced apart from said cross leg by a distance corresponding to the dimensions of a tip of a ski stick, whereby pivotal movement of a ski stick whose tip is inserted between said cross legs produces corresponding resetting pivotal movement of the hoop.

13. A ski binding according to claim 12, in which said additional cross leg is provided in front of and vertically above said cross leg when said resetting lever is in said rest position.

14. A ski binding according to claim 12, in which the side shanks of said hoop are bent downwardly towards the rear ends thereof.

15. A ski binding according to claim 2, in which said first cooperating pair of abutment means comprises in respect of said at least one brake arm a projection projecting sideways from the resetting lever and cooperable with said brake arm 16. A ski binding according to claim 2, in which said resetting lever comprises a hoop passing around the binding housing, the ends of the hoop adjacent said shaft being provided with sleeves rotatably arranged on the shaft, at least one of said sleeves being provided with a peripheral slot cooperable with a pin projecting radially from said shaft, the ends of said peripheral slot and associated side surfaces of said pin defining said first and second cooperating pairs of abutment means.

17. A ski binding according to claim 1, including means for producing counter rotation of the resetting lever and said at least one brake arm.

18. A ski binding according to claim 17, in which the pivot axis of said resetting lever is displaced from said axis of said shaft.

19. A ski binding according to claim 18, in which an intermediate member is journaled on said brake shaft, there being cooperating gear teeth on said intermediate member and said resetting lever, and said first pair of cooperating abutment means being defined between the intermediate member and said at least one brake arm.

20. A ski binding according to claim 19, wherein said second pair of cooperating abutment means are respectively associated with said intermediate member and said at least one brake arm.

21. A ski binding according to claim 1, in which said resetting lever is a hoop made of stiff wire.

22. A ski binding according to claim 1, in which said resetting lever is made from sheet metal.

* * * * *